US005505325A

United States Patent [19]

Thompson et al.

[11] Patent Number: 5,505,325

[45] Date of Patent: Apr. 9, 1996

[54] TAMPER EVIDENT DUAL NON-REPLACEABLE SNAP-ON CAP

[75] Inventors: Richard Thompson, 1816 SE. 9th St., Ft. Lauderdale, Fla. 33316; Edward Towns, Monroe, N.C.; Melvin O'Leary, Jr., Springfield, Mass.; Alan Morini, Jr., Granby, Mass.; Daniel B. Burnett, South Hadley, Mass.; Hank DiSalvatore, New Castle, Pa.

[73] Assignee: Richard Thompson, Fort Lauderdale, Fla.

[21] Appl. No.: 360,337

[22] Filed: Dec. 21, 1994

[51] Int. Cl.[6] ..... B65D 51/18

[52] U.S. Cl. ..... 220/254; 222/541.9

[58] Field of Search ..... 220/253, 254, 220/257, 266; 215/254, 251, 224, 225; 222/541, 546, 562

[56] References Cited

U.S. PATENT DOCUMENTS

| | | | |
|---|---|---|---|
| 3,504,818 | 4/1970 | Crisci et al. . | |
| 3,682,345 | 8/1972 | Baugh . | |
| 3,902,621 | 9/1975 | Hidding . | |
| 3,902,921 | 9/1975 | Augustynski et al. . | |
| 3,963,139 | 6/1976 | Gach . | |
| 3,980,195 | 9/1976 | Fillmore . | |
| 4,034,882 | 7/1977 | Wright . | |
| 4,053,007 | 10/1977 | Griffith . | |
| 4,076,151 | 2/1978 | Littlefield | 222/541 X |
| 4,084,716 | 4/1978 | Bogert . | |
| 4,171,749 | 10/1979 | Obrist et al. | 222/541 X |
| 4,349,134 | 9/1982 | Schuster et al. | 222/562 X |
| 4,469,253 | 9/1984 | Beard . | |
| 4,500,016 | 2/1985 | Funfstuck . | |
| 4,561,553 | 12/1985 | Crisci . | |
| 4,565,294 | 1/1986 | Smith | 220/257 X |
| 4,589,561 | 5/1986 | Crisci . | |
| 4,664,288 | 5/1987 | Pereira et al. | 222/541 X |
| 4,796,769 | 1/1989 | Obadia | 222/541 X |
| 4,801,032 | 1/1989 | Crisci . | |
| 4,940,003 | 7/1990 | Mayhew et al. . | |
| 5,046,646 | 9/1991 | Stull | 222/541 O |
| 5,104,008 | 4/1992 | Crisci . | |
| 5,105,967 | 4/1992 | Horpestad . | |

*Primary Examiner*—Allan N. Shoap
*Assistant Examiner*—Robin A. Hylton
*Attorney, Agent, or Firm*—Harpman & Harpman

[57] ABSTRACT

A tamper evident dual snap on cap and spout for a plastic bottle neck has a removable first closure having an upper skirt and an upstanding spout with an inwardly spaced sealing flange. A tear skirt joined to the lower most edge of the upper skirt with a circumferential tear line and depending tab extending therefrom. A second closure has an annular band engageable on a portion of the bottle neck, an inwardly spaced sealing flange and a pour spout engageable with the upstanding spout and inwardly spaced sealing flange of the first closure. Removal of the tear skirt allows removal of the first closure and access to the closure's pour spout.

7 Claims, 2 Drawing Sheets

TAMPER EVIDENT DUAL NON-REPLACEABLE SNAP-ON CAP

BACKGROUND OF THE INVENTION

1. Technical Field

This device relates to tamper indicating closures for containers and the like having a non-resealable pour spout on bottles containing perishable human consumable contents such as milk.

2. Description of Prior Art

Prior art devices of this type have been directed to a variety of tamper evident caps and bottle neck configurations that indicate removal of the closures. Resealable bottle closures have also been developed that use a push pull pour spout having a dual tamper evident system for both the reusable spout and the closure on the container. Prior art closures of varying types may be seen in U.S. Pat. Nos. 5,104,008, 5,105,967, 4,940,003, 4,801,032, 4,589,561, 4,561,533, 4,500,016, 4,469,253, 3,902,621, 4,804,716, 4,053,007, 4,034,882, 3,980,195, 3,963,139, 3,902,921, 3,682,345, and 3,504,818.

SUMMARY OF THE INVENTION

Dual snap on closures for bottles having dual interengaging spout configurations wherein a first closure has a tamper evident band engageable on a second closure registerable on the bottle to indicate removal of the first closure from sealing relationship with the second closure which is non-removable from a neck portion of the bottle. Sealing flanges on the closure engage the pour spout and bottle neck respectively.

DESCRIPTION OF THE PREFERRED EMBODIMENT

Figure 1:
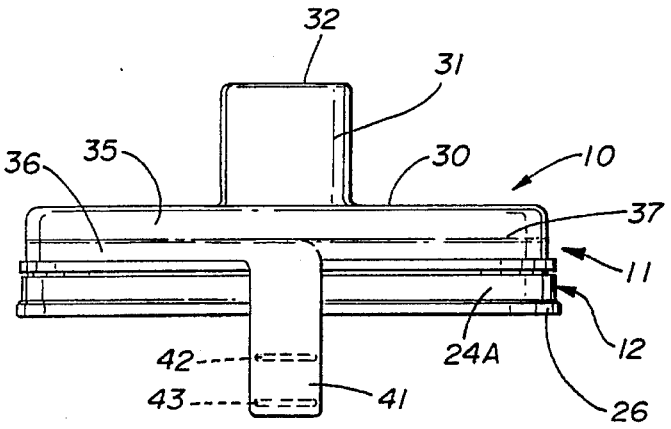
FIG. 1 is a side elevational view of the dual tamper evident closure of the invention.
Figure 2:
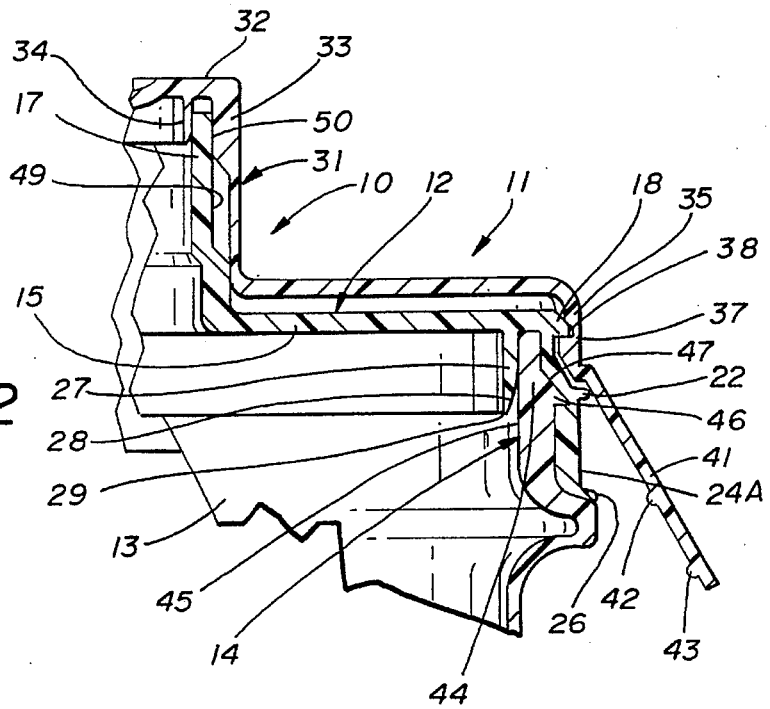
FIG. 2 is a partial enlarged cross-sectional view of a portion of the dual tamper evident closure on a bottle neck in sealing position.
Figure 3:
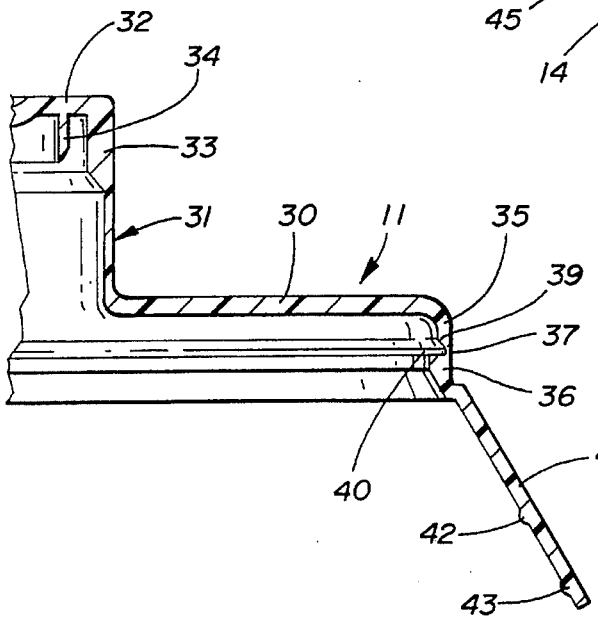
FIG. 3 is an enlarged partial cross-sectional view of the tamper evident first closure.
Figure 4:
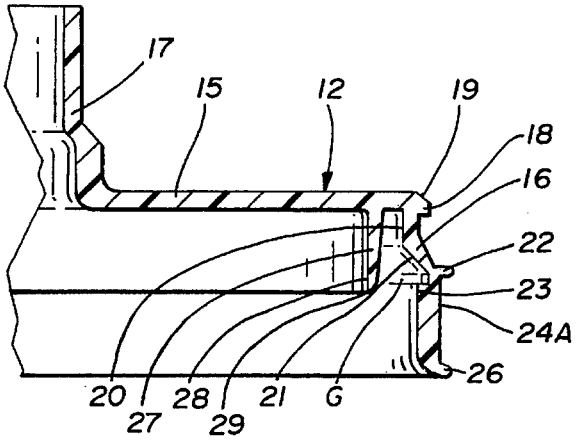
FIG. 4 is an enlarged partial cross-sectional view of the tamper evident second closure.
Figure 5:
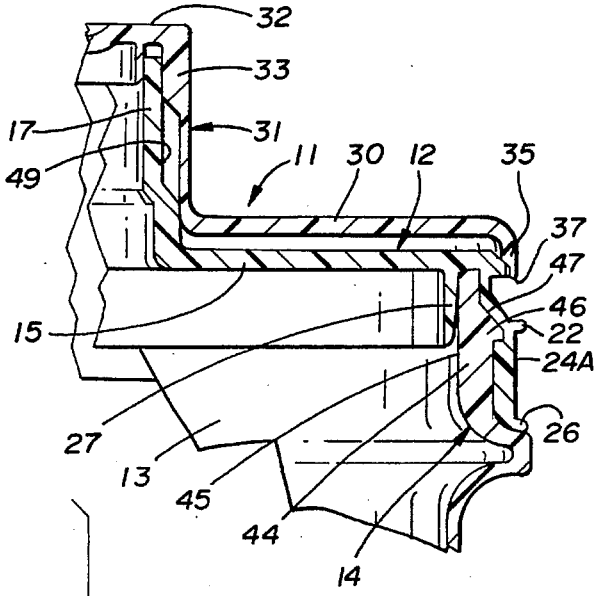
FIG. 5 is a partial enlarged cross-sectional view of a portion of the dual tamper evident closure on the bottle neck with the tear skirt removed for opening.

Referring to FIGS. 1, 2 and 5 of the drawings, a non-resealable dual tamper evident closure 10 can be seen comprising a first cap 11 positioned on a second cap 12 on a bottle 13 having a neck portion 14. The second cap 12 comprises a top portion 15 having an integral depending annular flange 16 extending therefrom. An opening is formed in the center of the top portion 15 of the second cap defined by an upstanding cylindrical pour spout 17 thereabout. The top portion 15 has an annular cap locking flange 18 extending outwardly therefrom having a tapered shoulder 19. The depending annular flange 16 has an annular flat wall

20 portion extending from the top portion. An angular portion 21 extends outwardly immediately therebelow, the lower portion of which joins an annular rib 22 extending outwardly therefrom. An inturned annular flange 23 extends from the annular flange 16 having an annularly flat outside wall 24A defining a bottle engagement groove G therebetween with an annular out-turned flange 26 extending therefrom. An annular sealing flange 27 extends from the top portion 15 inwardly of the depending flange 16 to a point in spaced horizontal relationship to the inturned annular flange 23. The sealing flange 27 is tapered at 28 inwardly of its free end at 29. The first cap 11 has a top area 30 with an upstanding pour spout cap 31 formed in the center thereof. The pour spout cap 31 has a top portion 32 and an area of increased wall thickness at 33 opposite a depending annular sealing flange 34 spaced inwardly therefrom.

It will be seen that the first cap 11 has an annular depending upper skirt 35 with a tear skirt 36 joined to the lowermost edge defining an area of decreased thickness as a tear line at 37. The upper skirt 35 has an inwardly facing annular groove 38 having a tapered inner surface 39 and a vertically opposing horizontally disposed surface 40 which is registerable over the hereinbefore described cap locking flange 18 of the second cap 12 adjacent the tear line 37. The tear skirt 35 has an integral depending tear tab 41, best seen in FIGS. 1 and 2 of the drawings, having a pair of longitudinally spaced engagement ribs 42 and 43 which will be well known to those skilled in the art.

The bottle neck portion 14 has a lip portion 44 having vertically disposed annular sidewalls 45 with an outwardly extending annular locking flange 46 therebelow. The annular locking flange 46 has an upper angularly disposed shoulder surface 47 which defines an increased area of transverse thickness at 48 extending therefrom.

In assembled form as illustrated in FIGS. 1 and 2 of the drawings the first cap 11 is sealingly engaged onto the neck portion 14 of the bottle 13 where the neck lip portion 44 registers between the sealing flange 27 and the annular flat wall 20 of the second cap 12 with the locking flange 46 engaged within a registration groove formed within the annular depending flange 16 between the angular portion 21 and inturned annular flange 23 as hereinbefore described.

The upstanding pour spout 17 has an area of overall reduced transverse dimension at 49 in spaced vertical relation to the top portion 15. The first cap 11 is removably secured over the second cap 12 wherein the upstanding pour spout 17 is registerable within the pour spout cap 31 by overlapping engagement of the sealing flange 34 and respective annular spout portion at 50. The locking flange 18 of the second cap 12 registers in the annular groove 38 of the depending upper skirt 35 locking the first cap 11 thereon.

Figure 6:
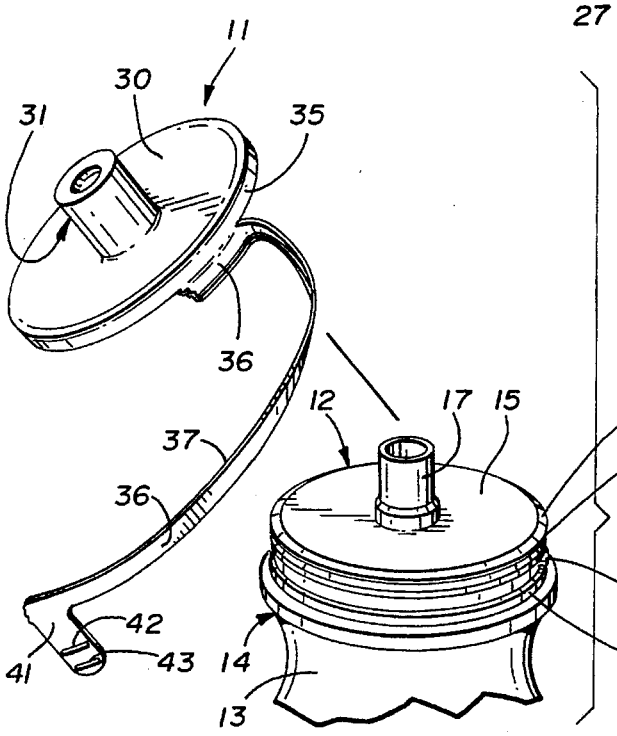
FIG. 6 is an enlarged partial perspective view of the dual tamper evident closure with the tamper evident first closure in removed relation to the remaining second non-removable closure on the bottle neck configuration with the tear skirt partially removed for opening.

To remove the first cap 11, the tear tab 41 is engaged and pulled upwardly and outwardly separating the tear skirt 36 from the upper skirt 35 along the tear line 37 to which the tear tab 41 extends as best seen in FIGS. 1 and 6 of the drawings. The partial removal of the tear skirt 36 allows the hereinbefore secured first cap 11 to be removed as illustrated primarily in FIG. 5 and in FIG. 6 leaving the second cap 12 secured to the bottle 13 allowing access to the hereinbefore described upstanding pour spout 17.

It will thus be apparent to those skilled in the art that various changes and modifications may be made therein without departing from the spirit of the invention.

Therefore I claim:

1. An improvement in a resilient molded plastic bottle cap for a bottle having a neck surrounding an opening, said neck having an annular locking flange extending outwardly therefrom in spaced vertical relation to said opening; the improvement comprising in combination a first cap and a second cap, said second cap having a top portion, an annular depending flange on the peripheral edge of said second cap, a bottle engagement groove formed inwardly thereon registerable with said locking flange, an annular sealing flange extending downwardly from said top portion in spaced horizontal relation to said annular flange, a cap locking annular flange on said top portion, an elongated, axially outwardly extending pour spout on said top portion communicating with an opening therein and means for secondary engagement with said first cap, said first cap comprising a top portion, a pour spout cap on said top portion sealingly engaging said pour spout, means for sealing said pour spout, an upper skirt extending from said top portion, a tear skirt extending from said upper skirt defining a tear line therebetween, means extending from said tear skirt for finger engagement and partial removal of said tear skirt from said upper skirt.

2. The improvement in a resilient molded plastic bottle cap in combination of claim 1 wherein said means for secondary engagement with said cap comprises an annular rib on said depending annular flange and a portion of said pour spout adjacent said top portion.

3. The improvement in a resilient molded plastic bottle cap in combination of claim 1 wherein said means for sealing said pour spout comprises an annular internal sealing flange on said pour spout cap.

4. The improvement in a resilient molded plastic bottle cap in combination of claim 1 wherein said first cap is of a known internal transverse dimension and said second cap is of an internal transverse dimension greater than that of said first cap.

5. The improvement in a resilient molded plastic bottle cap in combination of claim 1 wherein said locking annular flange on said top portion of said second cap has a tapered area thereon.

6. The improvement in a resilient molded plastic bottle cap in combination of claim 1 wherein said second cap is in sealing relation on said bottle neck and said first cap is sealingly engaged on said second cap, said top portion of said first and second cap in spaced vertical relation to one another.

7. The improvement in a resilient molded plastic bottle cap in combination of claim 1 wherein said means extending from said tear skirt comprising an elongated tear tab extending downwardly beyond said depending annular flange of said second cap.

* * * * *